US008292674B1

(12) United States Patent
Yang et al.

(10) Patent No.: US 8,292,674 B1
(45) Date of Patent: Oct. 23, 2012

(54) ELECTRICAL CONNECTOR

(75) Inventors: Cheng-Wang Yang, Guang-Dong (CN); Kai-Hsiang Chang, New Taipei (TW); Chao-Yong Ye, Guang-Dong (CN)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/233,031

(22) Filed: Sep. 15, 2011

(51) Int. Cl.
*H01R 24/00* (2006.01)

(52) U.S. Cl. ..... 439/660; 439/587

(58) Field of Classification Search ..... 439/271, 439/277, 278, 320, 587, 589, 693, 660, 582
See application file for complete search history.

(56) References Cited

U.S. PATENT DOCUMENTS 7,029,328 B1 * 4/2006 Mckenzie et al. ..... 439/587
7,922,535 B1 * 4/2011 Jiang et al. ..... 439/607.35
8,047,877 B1 * 11/2011 Liu et al. ..... 439/660
8,070,516 B2 * 12/2011 Chiang ..... 439/607.27
8,147,272 B2 * 4/2012 Rhein ..... 439/556

* cited by examiner

*Primary Examiner* — Edwin A. Leon
*Assistant Examiner* — Harshad Patel
(74) *Attorney, Agent, or Firm* — Cheng-Ju Chiang

(57) ABSTRACT

An electrical connector includes a dielectric body, a plurality of terminals molded in the dielectric body and an insulating housing. The dielectric body has a base portion, and a tongue portion. A rear end of the tongue portion defines a ring-shaped cavity for receiving a ring-shaped waterproof ring therein. The insulating housing has a top wall, two side walls and a bottom wall interconnected with one another to form an accommodating space thereamong. A ring-shaped blocking wall with an insertion groove formed therein is connected with inner sides of the top wall, the two side walls and the bottom wall. The tongue portion is inserted into a front of the accommodating space through the insertion groove with an outer periphery of the waterproof ring resisting against an inner sidewall of the insertion groove, and a front of the base portion abutting against a rear of the blocking wall.

8 Claims, 5 Drawing Sheets

ELECTRICAL CONNECTOR

BACKGROUND OF THE INVENTION

1. Field of the Invention

The present invention generally relates to an electrical connector, and more particularly to an electrical connector having a tight and stable structure.

2. The Related Art

With fast development of electronic industry, current electrical connectors are widely used in electronic products, such as cell phones, computers and so on. The electrical connector includes a dielectric body, an insulating housing and a plurality of terminals. The dielectric body defines a plurality of terminal grooves for receiving the terminals. The insulating housing defines an accommodating space. The dielectric body together with the terminals is received in the accommodating space. However, intervals are formed among the terminals and the terminal grooves. When a mated connector is inserted into the accommodating space to contact with the terminals, the terminals are apt to be deformed on account of the intervals among the terminals and the terminal grooves. Moreover, the dielectric body and the insulating housing can't be combined tightly, so moisture enters the accommodating space of the insulating housing easily. In consequence, electrical performance of the electrical connector is unsteady.

SUMMARY OF THE INVENTION

An object of the present invention is to provide an electrical connector adapted to be soldered on a printed circuit board includes a dielectric body, a plurality of terminals and an insulating housing. The dielectric body has a base portion, and a tongue portion protruded forward from a front of the base portion. A rear end of the tongue portion is concaved inward to form a ring-shaped cavity for receiving a ring-shaped waterproof ring therein. The terminals are molded in the dielectric body with front ends thereof exposed in a top of the tongue portion and rear ends thereof projected out of the base portion to be soldered on the printed circuit board. The insulating housing has a top wall, two side walls and a bottom wall which are interconnected with one another to form an accommodating space thereamong. A ring-shaped blocking wall with an insertion groove formed therein is connected with inner sides of the top wall, the two side walls and the bottom wall. The tongue portion of the dielectric body is inserted into a front of the accommodating space through the insertion groove with an outer periphery of the waterproof ring resisting against an inner sidewall of the insertion groove, and the base portion is engaged with a rear of the accommodating space with a front side of the base portion abutting against a rear side of the blocking wall.

As described above, the terminals are molded in the dielectric body to effectively prevent the terminals deformed when a mated connector is engaged with the electrical connector. Furthermore, the outer periphery of the waterproof ring resists against the inner sidewall of the insertion groove and the front side of the base portion abuts against the rear side of the blocking wall for blocking moisture from entering the accommodating space along a rear of the insulating housing. So, a stable and tight structure of the electrical connector is got to assure a better electrical performance of the electrical connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
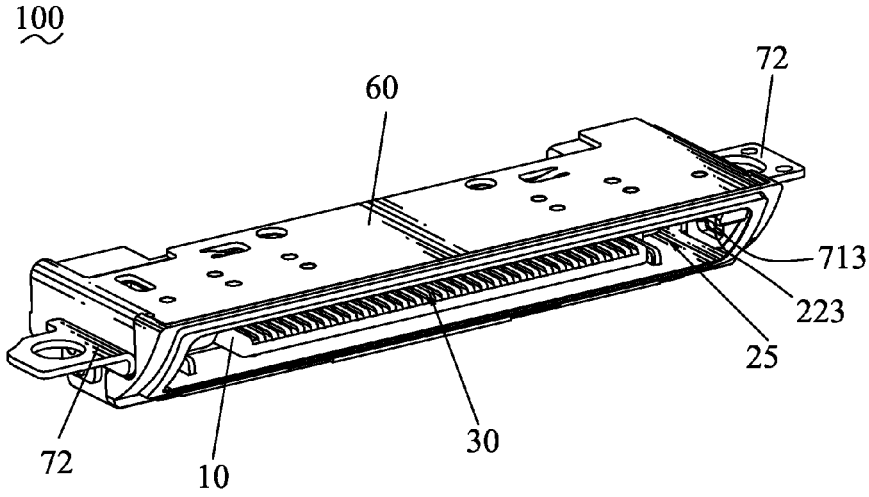
FIG. 1 is a perspective view of an electrical connector in accordance with the present invention.
Figure 2:
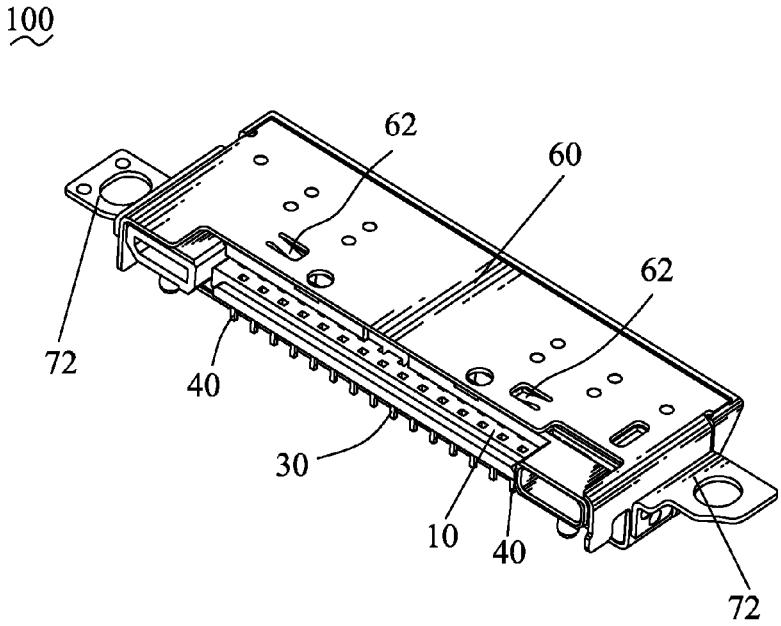
FIG. 2 is another perspective view of the electrical connector of FIG. 1.
Figure 3:
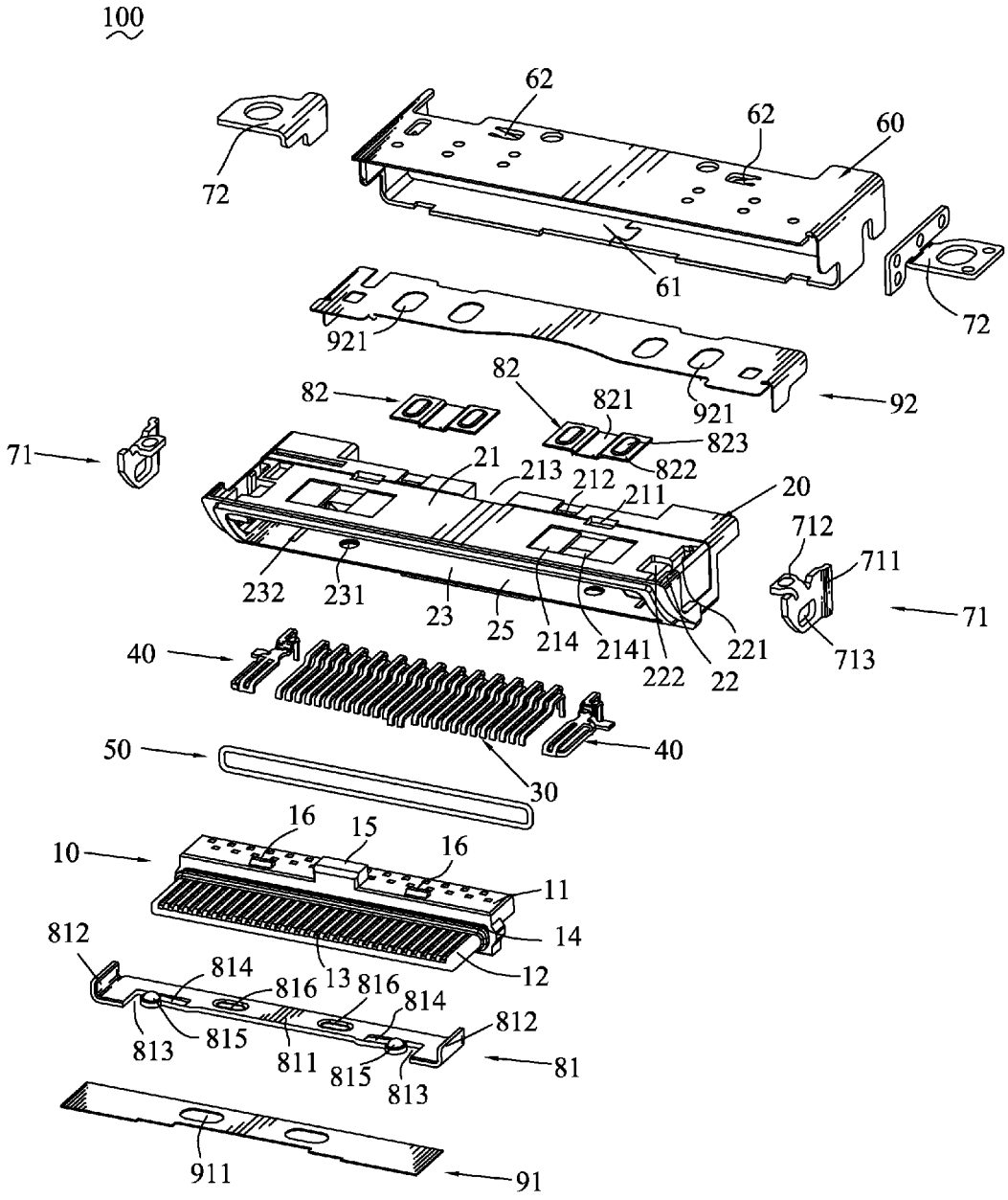
FIG. 3 is an exploded view of the electrical connector of FIG. 1.

With reference to FIGS. 1-3, an electrical connector 100 in accordance with the present invention is shown. The electrical connector 100 adapted to be soldered on a printed circuit board (not shown) includes a dielectric body 10, an insulating housing 20, a plurality of conductive terminals 30, a pair of ground terminals 40, a ring-shaped waterproof ring 50, a shielding shell 60, a pair of latches 71, a pair of fastening elements 72, a first connecting element 81, a pair of second connecting elements 82, a first sealing element 91 and a second sealing element 92.

Figure 4:
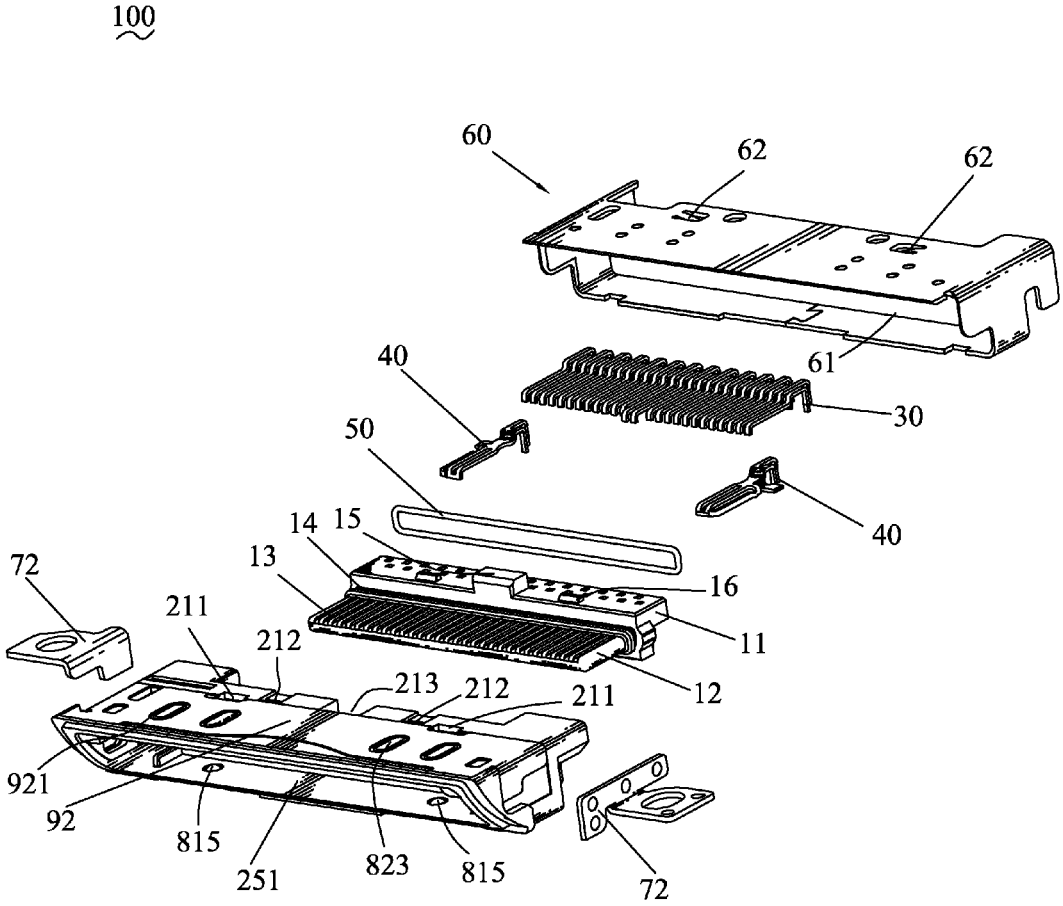
FIG. 4 is a partially exploded view of the electrical connector of FIG. 1.
Figure 5:
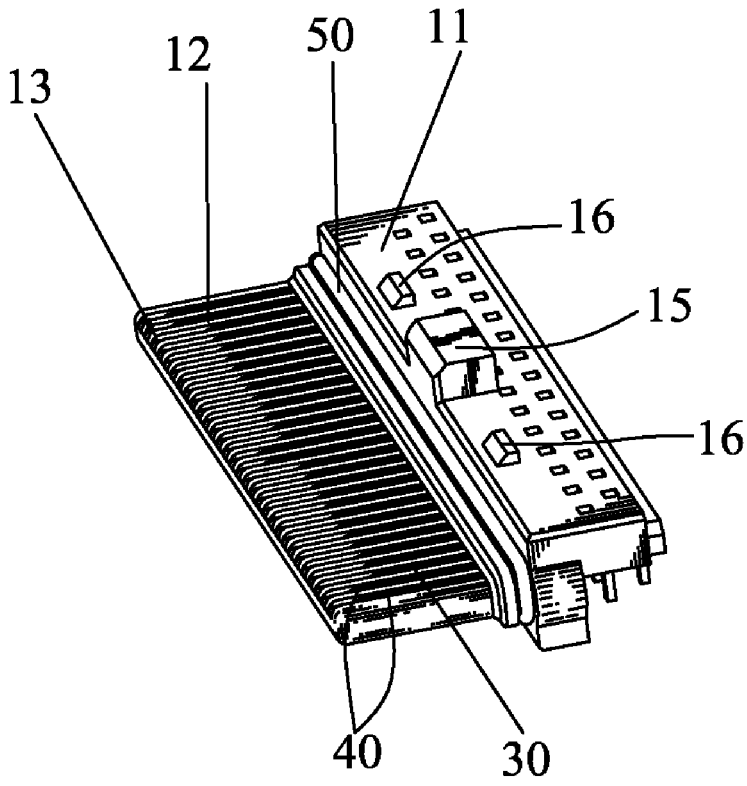
FIG. 5 is a perspective view of an insulating housing of the electrical connector of FIG. 3, wherein a plurality of conductive terminals, at least one ground terminal and a waterproof ring are mounted in the insulating housing.
Figure 6:
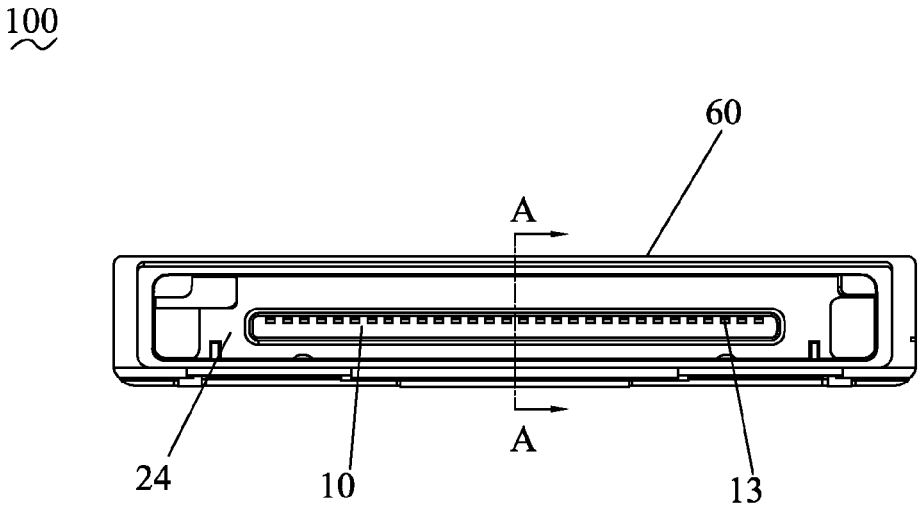
FIG. 6 is a front view of the electrical connector of FIG. 1.
Figure 7:
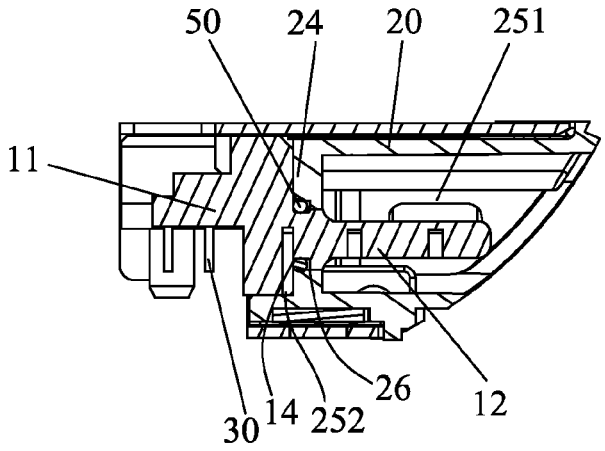
FIG. 7 is a sectional perspective view of the electrical connector along a line A-A of FIG. 4.

Referring to FIG. 3 and FIG. 4, the dielectric body 10 has a base portion 11 and a tongue portion 12 protruded forward from a middle of a front of the base portion 11. The dielectric body 10 defines a plurality of terminal grooves 13 of which each extends longitudinally along a top of the tongue portion 12 and further penetrates through a bottom of the base portion 11. A rear end of the tongue portion 12 is concaved inward to form a ring-shaped cavity 14 seen from a front view of the dielectric body 10 and adjacent to the base portion 11. A front of a top of the base portion 11 defines a locating portion 15 protruded upward from a middle thereof, and two trapezoid buckling portions 16 protruded upward from two sides thereof.

Referring to FIG. 1, FIG. 2, FIG. 3, FIG. 6 and FIG. 7, the insulating housing 20 has a top wall 21, two side walls 22 extending downward from two opposite sides of the top wall 21, and a bottom wall 23 parallel to the top wall 21 and connecting with the two side walls 22. An accommodating space 25 is formed among the top wall 21, the two side walls 22 and the bottom wall 23. A ring-shaped blocking wall 24 is connected with inner sides of the top wall 21, the two side walls 22 and the bottom wall 23 to divide the accommodating space 25 into a first accommodating space 251 at a front of the insulating housing 20 and a second accommodating space 252 at a rear of the insulating housing 20. An insertion groove 26 is formed in a middle of the ring-shaped blocking wall 24 and communicated between the first accommodating space 251 and the second accommodating space 252. A top of the top wall 21 defines two recesses 211 transversely spaced from each other. The top wall 21 defines two buckling grooves 212 transversely spaced from each other and vertically penetrating therethrough. The two buckling grooves 212 are located behind an interval between the two recesses 211. A middle of a rear side of the top wall 21 is cut off to define a notch 213. The top wall 21 defines two locating grooves 214 transversely spaced from each other and respectively located in front of the two recesses 211. A middle of a bottom wall of the locating groove 214 defines a locating hole 2141.

Each side wall 22 of the insulating housing 20 defines a clipping groove 221 extending longitudinally to pass through a top of the corresponding side wall 22. Two opposite inner sidewalls of the clipping grooves 221 define two through-holes 223 communicated with the accommodating space 25. Two portions of two opposite inner sides of two tops of the two clipping grooves 221 extend face to face to form two fixing grooves 222. The bottom wall 23 defines two inserting slots 232 vertically penetrating therethrough, and two circular holes 231 located between the two inserting slots 232.

Referring to FIG. 3, the shielding shell 60 is looped from a metal plate with a receiving space 61 formed therein. Two opposite ends of a top of the shielding shell 60 are punched inward into the receiving space 61 to form two elastic portions 62.

Referring to FIG. 3, each latch 71 has a clipping portion 711 disposed vertically with a matching hole 713 being formed therein. A front portion of a top of the clipping portion 711 is bent perpendicular to the clipping portion 711 to form a contact portion 712.

Referring to FIG. 3, the first connecting element 81 has a base plate 811. Two opposite ends of the base plate 811 extend upward to form two insertion plates 812. Two portions of a front side of the base plate 811 are cut off to define two mouths 813. One inner end of each mouth 813 far away from the corresponding insertion plate 812 inclines upward and extends towards the other inner end of the mouth 813 to form a cantilever arm 814. A free end of the cantilever arm 814 spreads outward and protrudes upward to form a hemisphere-shaped touching portion 815. Two portions of a top of the base plate 811 are punched downward to form two first fastening portions 816 spaced from each other and located between the two mouths 813.

Referring to FIG. 3, the second connecting element 82 has a base piece 821. Two opposite sides of the base piece 821 extend upward and then extend oppositely to form two locating pieces 822 with two second fastening portions 823 being protruded upward therefrom. The second sealing element 92 defines a plurality of second fastening holes 921 matching with the second fastening portions 823. The first sealing element 91 defines two first fastening holes 911 matching with the first fastening portions 816.

Referring to FIGS. 1-7, in assembly, the conductive terminals 30 and the ground terminals 40 are molded in the terminal grooves 13 of the dielectric body 10 to effectively prevent the conductive terminals 30 and the ground terminals 40 deformed when the electrical connector 100 is engaged with a mated connector (not shown), with front ends thereof exposed in the top of the tongue portion 12 and rear ends thereof projected out of the dielectric body 10 to be soldered on the printed circuit board. The waterproof ring 50 is clipped in the cavity 14 of the tongue portion 12 of the dielectric body 10. The dielectric body 10 is inserted in the accommodating space 25 with the tongue portion 12 stretched into the first accommodating space 251 through the insertion groove 26 of the blocking wall 24 and the base portion 11 engaged with the second accommodating space 252. An outer periphery of the waterproof ring 50 resists against an inner sidewall of the insertion groove 26 and a front side of the base portion 11 abuts against a rear side of the blocking wall 24 for blocking moisture entering the accommodating space 25 along the rear of the insulating housing 20. The locating portion 15 and the buckling portions 16 are respectively received in the notch 213 and the buckling grooves 212 to fasten the dielectric body 10 in the accommodating space 25 of the insulating housing 20 firmly.

Then the first connecting element 81 is mounted to a bottom of the bottom wall 23 with the insertion plates 812 inserted in the inserting slots 232, the touching portions 815 exposed in the first accommodating space 251 through the circular holes 231 and the first fastening portions 816 exposed under the bottom wall 23. The first sealing element 91 is mounted under the first connecting element 81 with the two first fastening portions 816 inserted in the two first fastening holes 911 to seal up chinks between the insertion plates 812 and the inserting slots 232 and interstices between the touching portions 815 and the circular holes 231 to prevent the moisture entering the first accommodating space 251 from a bottom of the insulating housing 20. The locating pieces 822 are located in two sides of the locating grooves 214, and the base pieces 821 inserted in the locating holes 2141 with the fastening portions 823 exposed beyond a top of the top wall 21 of the insulating housing 20. The clipping portions 711 of the two latches 71 are inserted in the clipping grooves 221, the contact portions 712 are received in the fixing grooves 222 and the matching holes 713 correspond to the through-holes 223. The second sealing element 92 is mounted on the top wall 21 of the insulating housing 20 to seal up chinks between the second connecting elements 82 and the locating grooves 214 and chinks between the latches 71 and the clipping grooves 221 to prevent the moisture entering the first accommodating space 251 from the top of the insulating housing 20. The insulating housing 20 together with the first sealing element 91 and the second sealing element 92 surrounded thereon is inserted into the receiving space 61 of the shielding shell 60 with the elastic portions 62 buckled in the buckling grooves 212. The fastening elements 72 are mounted to two sides of the shielding shell 60 to be soldered on the printed circuit board.

As described above, the conductive terminals 30 and the ground terminals 40 are molded in the terminal grooves 13 of the dielectric body 10 to effectively prevent the conductive terminals 30 and the ground terminals 40 deformed when the electrical connector 100 is engaged with the mated connector. Furthermore, the outer periphery of the waterproof ring 50 resists against the inner sidewall of the insertion groove 26 and the front side of the base portion 11 abuts against the rear side of the blocking wall 24 for blocking the moisture from entering the accommodating space 25 along the rear of the insulating housing 20. So, a stable and tight structure of the electrical connector 100 is got to assure a better electrical performance of the electrical connector 100.

What is claimed is:

1. An electrical connector adapted to be soldered on a printed circuit board, comprising:

a dielectric body having a base portion, and a tongue portion protruded forward from a front of the base portion, a rear end of the tongue portion being concaved inward to form a ring-shaped cavity for receiving a ring-shaped waterproof ring therein;

a plurality of terminals molded in the dielectric body with front ends thereof exposed in a top of the tongue portion and rear ends thereof projected out of the base portion to be soldered on the printed circuit board; and an insulating housing having a top wall, two side walls and a bottom wall which are interconnected with one another to form an accommodating space thereamong, a ring-shaped blocking wall with an insertion groove formed therein being connected with inner sides of the top wall, the two side walls and the bottom wall, the tongue portion of the dielectric body being inserted into a front of the accommodating space through the insertion groove with an outer periphery of the waterproof ring resisting against an inner sidewall of the insertion groove, and the base portion being engaged with a rear of the accommodating space with a front side of the base portion abutting against a rear side of the blocking wall.

2. The electrical connector as claimed in claim 1, further comprising a first connecting element mounted to a bottom of the bottom wall, the first connecting element having a base plate abutting against the bottom of the bottom wall, two opposite ends of the base plate extending upward to form two insertion plates, a front side of the base plate defining two mouths, one inner end of each mouth inclining upward and extending towards the other inner end of the mouth to form a cantilever arm, a free end of the cantilever arm spreading outward and protruding upward to form a touching portion, the bottom wall defining two inserting slots for receiving the two insertion plates, and two circular holes for receiving the touching portions.

3. The electrical connector as claimed in claim 2, wherein two portions of the base plate are punched downward to form two first fastening portions, the electrical connector further includes a first sealing element mounted under the first connecting element with the two first fastening portions being inserted in two first fastening holes formed in the first sealing element to seal up chinks between the insertion plates and the inserting slots and interstices between the touching portions and the circular holes.

4. The electrical connector as claimed in claim 1, further comprising two second connecting elements of which each has a base piece, two sides of the base piece extending upward and then extending outward to form two locating pieces, the top wall defining two locating grooves, the two locating pieces of each second connecting element being located in two sides of the locating groove, a bottom wall of the locating groove defining a locating hole for receiving the base piece therein.

5. The electrical connector as claimed in claim 4, further comprising two latches, each latch having a clipping portion with a matching hole being formed therein, a front portion of a top of the clipping portion being bent perpendicular to the clipping portion to form a contact portion, each side wall of the insulating housing defining a clipping groove extending longitudinally for receiving the clipping portion, two opposite inner sidewalls of the clipping grooves defining two through-holes corresponding to the matching holes and communicated with the accommodating space, two tops of the two clipping grooves extending face to face to form two fixing grooves for receiving the contact portions.

6. The electrical connector as claimed in claim 5, wherein two second fastening portions are protruded upward from the locating pieces of each second connecting element and beyond a top of the top wall of the insulating housing, the electrical connector further includes a second sealing element mounted on the top wall of the insulating housing with the second fastening portions being inserted in second fastening holes formed in the second sealing element to cover chinks between the second connecting elements and the locating grooves, and chinks between the latches and the clipping grooves.

7. The electrical connector as claimed in claim 1, wherein the top wall defines two buckling grooves and a notch located between the two buckling grooves and passing through a rear side of the top wall, a top of the base portion defines two trapezoid buckling portions buckled in the buckling grooves and a locating portion protruded upward between the two buckling portions to be located in the notch.

8. The electrical connector as claimed in claim 1, further comprising a shielding shell surrounding the insulating housing, two opposite ends of a top of the shielding shell being punched inward to form two elastic portions, the top wall defining two recesses transversely spaced from each other for bucking the two elastic portions therein.

* * * * *